US006758791B1

(12) United States Patent
Kuo

(10) Patent No.: US 6,758,791 B1
(45) Date of Patent: Jul. 6, 2004

(54) TILTABLE AND FOLDABLE TREADMILL DEVICE

(76) Inventor: Hai Pin Kuo, No. 15, Lane 833, Wen Hsien Road, Tainan (TW), 704

( * ) Notice: Subject to any disclaimer, the term of this patent is extended or adjusted under 35 U.S.C. 154(b) by 0 days.

(21) Appl. No.: 10/397,893

(22) Filed: Mar. 26, 2003

(51) Int. Cl.[7] ..... A63B 22/02
(52) U.S. Cl. ..... 482/54
(58) Field of Search ..... 482/51, 54, 904

(56) References Cited

U.S. PATENT DOCUMENTS 5,772,560 A 6/1998 Watterson et al. ..... 482/54
5,899,834 A * 5/1999 Dalebout et al. ..... 482/54
6,273,842 B1 * 8/2001 Wang et al. ..... 482/54
6,638,200 B2 * 10/2003 Chang ..... 482/54

* cited by examiner

*Primary Examiner*—Stephen R. Crow
(74) *Attorney, Agent, or Firm*—Charles E. Baxley

(57) ABSTRACT

A treadmill device includes a seat having an oblong hole and a channel, a tread base having a front shaft movable up and down along the oblong hole of the seat, to adjust the tread base relative to the seat to different inclinations. An actuating device is coupled between the tread base and the seat and has a pivot axle slidably received in the channel of the seat. The actuating device may move the pivot axle along the channel of the seat, and to move the pivot shaft along the oblong hole of the seat, and to rotate the tread base to a folding position when the shaft is moved to the upper portion of the oblong hole of the seat, and when the pivot axle is moved to the front portion of the channel of the seat.

5 Claims, 5 Drawing Sheets

TILTABLE AND FOLDABLE TREADMILL DEVICE

BACKGROUND OF THE INVENTION

1. Field of the Invention

The present invention relates to a treadmill device, and more particularly to a treadmill device including a tiltable and a foldable configuration.

2. Description of the Prior Art

Various kinds of typical treadmill devices have been developed and used today, and comprise a tread base secured or attached to an erected frame, for supporting users. Normally, the tread base is solidly secured to the erected frame and may not be rotated or folded relative to the erected frame, such that the typical treadmill devices include a great volume that is adverse for storing and transportation purposes.

For allowing the treadmill devices to be rotated or folded to a greatly reduced volume or to a compact configuration, some of the typical treadmill devices include a tread base rotatably or foldably secured or attached to the erected frame, for allowing the tread base to be folded or rotated upwardly to engage with the erected frame, and for facilitating the storing and transportation of the typical treadmill devices.

For example, U.S. Pat. No. 5,772,560 to Watterson et al. discloses one of the typical treadmill devices including a tread base rotatable or foldable upwardly to engage with the erected frame, and to an upward folding or storing position that is excellent for storing and transportation purposes.

However, the center of gravity of the tread base will be elevated and may not be lowered when the tread base is rotated or folded upwardly to the upward folding or storing position, such that the typical treadmill devices may be unstable. Furthermore, the tread base of the typical treadmill devices may not be adjusted to different inclinations or slopes.

The present invention has arisen to mitigate and/or obviate the afore-described disadvantages of the conventional treadmill devices.

SUMMARY OF THE INVENTION

The primary objective of the present invention is to provide a treadmill device having a tread base that may be adjusted to different inclinations or slopes.

In accordance with one aspect of the invention, there is provided a treadmill device comprising a seat including a panel having an oblong hole formed therein, the oblong hole of the seat including an upper portion and a lower portion, and the seat including a channel laterally formed therein and having a front portion and a rear portion, a tread base including a rear portion, and including a front portion having a pivot shaft provided thereon and slidably received in the oblong hole of the seat, the pivot shaft of the tread base being movable up and down along the oblong hole of the seat, to adjust the tread base relative to the seat to different inclinations, an actuating device including a first end pivotally coupled to the tread base, and a second end having a pivot axle provided thereon and slidably received in the channel of the seat, and a lever coupled between the pivot shaft and the pivot axle, to pivotally couple the front portion of the tread base and the second end of the actuating device together. The actuating device is provided to move the pivot axle along the channel of the seat, and to move the pivot shaft along the oblong hole of the seat, and to rotate the tread base upwardly to a folding position when the pivot shaft is moved to the upper portion of the oblong hole of the seat, and when the pivot axle is moved to the front portion of the channel of the seat.

The actuating device includes a conduit pivotally and slidably secured to the seat with the pivot axle, and a rod slidably received in the conduit and having a free end pivotally coupled to the tread base. The actuating device includes a motor device to move the rod in and out of the conduit.

The seat includes a frame extended upward therefrom, and having at least one hand grip provided thereon to support users. The tread base includes at least one wheel device attached to the rear portion thereof to facilitate moving of the tread base relative to the seat.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
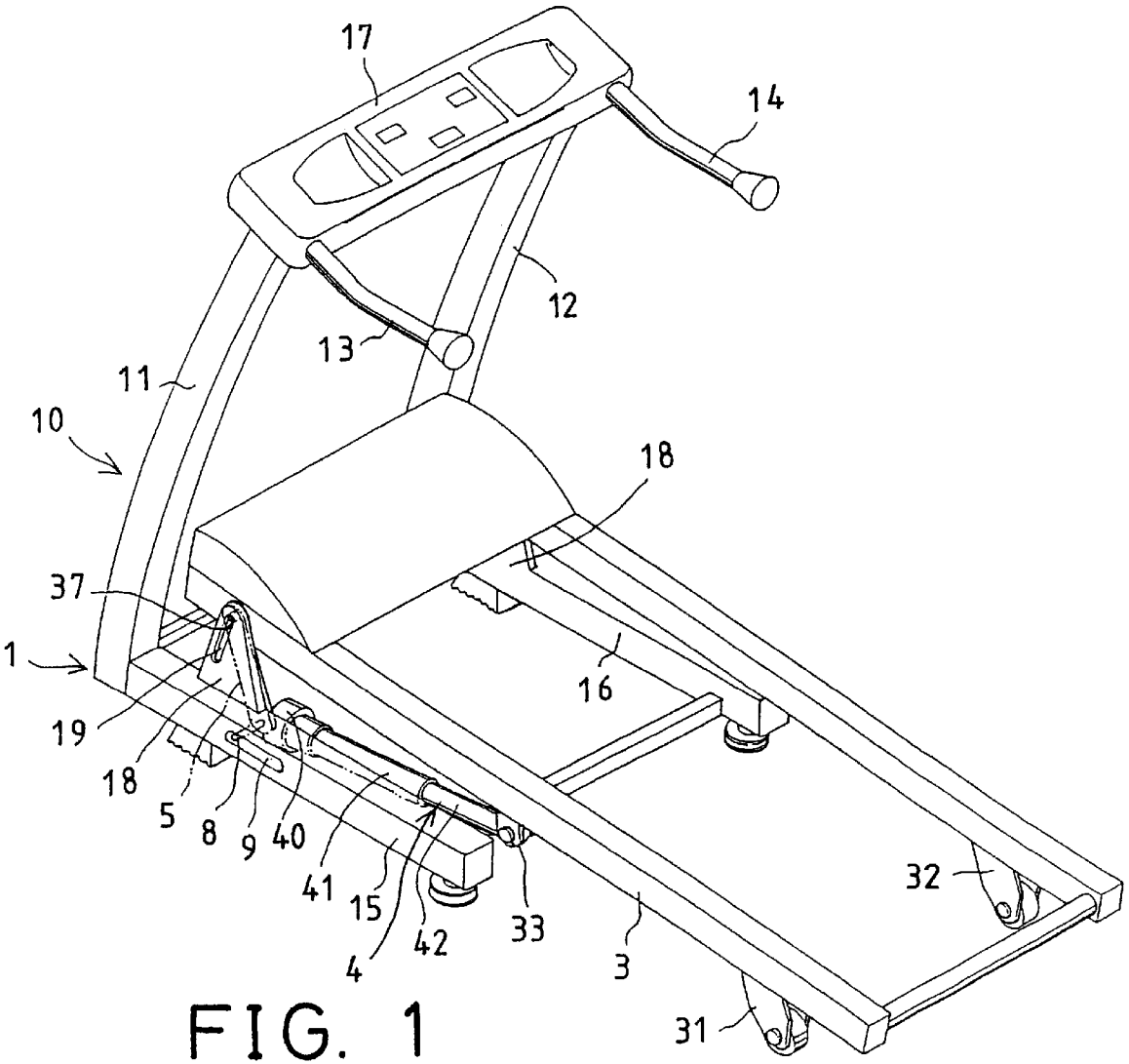
FIG. 1 is a perspective view of a treadmill device in accordance with the present invention.
Figure 2:
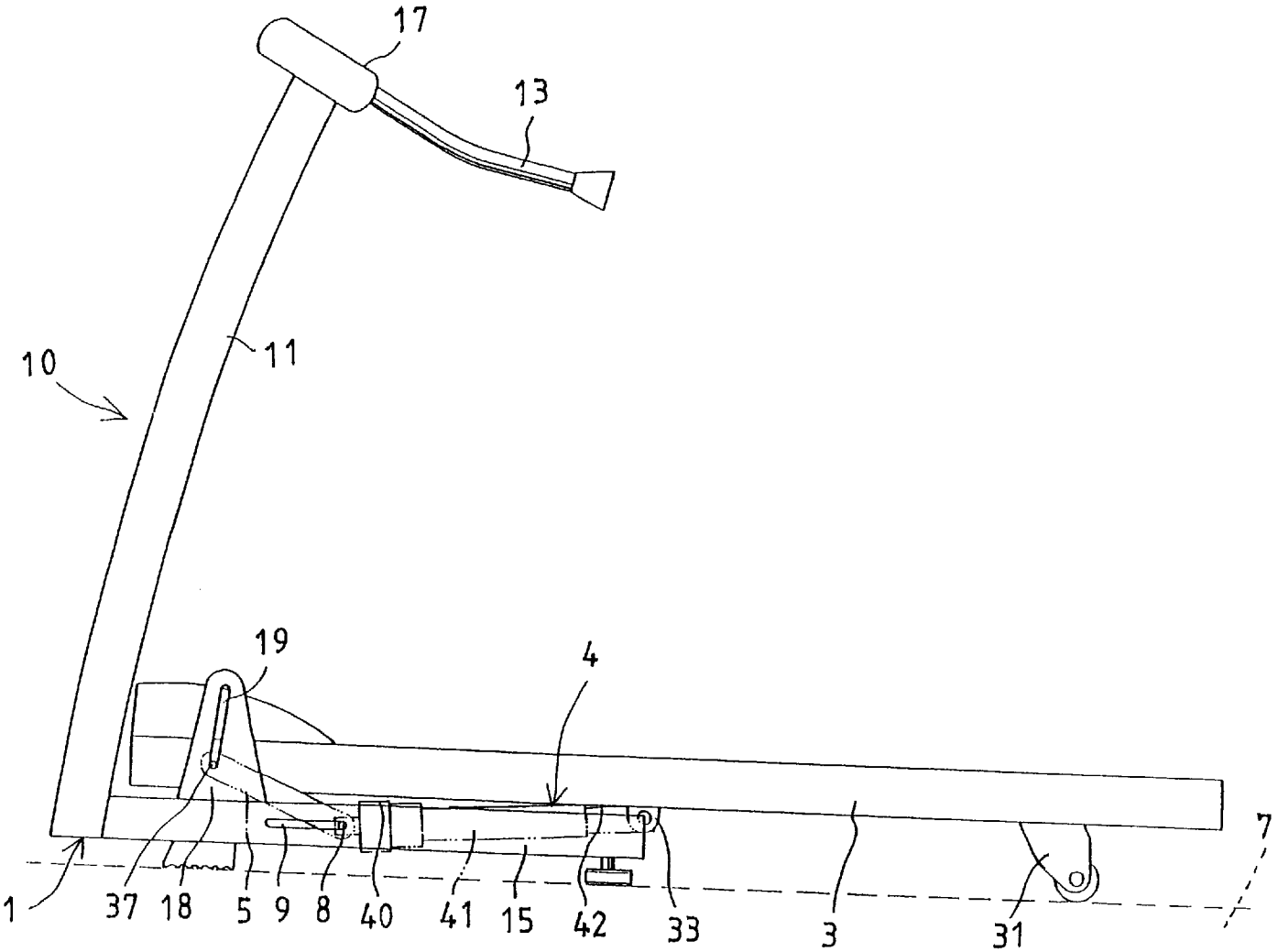
FIG. 2 is a side plan view of the treadmill device.

Referring to the drawings, and initially to FIGS. 1 and 2, a treadmill device in accordance with the present invention comprises a seat 1 having a frame 10 provided in the front portion thereof. For example, the frame 10 includes one or more posts 11, 12 extended upwardly from one or more beams 15, 16 of the seat 1 respectively, and includes one or more hand grips 13, 14 provided on top thereof for supporting the upper portion of the users, and may further include a control device 17 provided on top thereof.

The seat 1 further includes one or more, such as two panels 18 extended upwardly from the beams 15, 16 respectively. The panels 18 each may include an oblong hole 19 formed therein, and arranged tilted or inclined relative to the beams 15, 16, or arranged substantially up and down relative to the beams 15, 16. The seat 1 may further include one or more channels 9 laterally formed therein, such as formed in one of the beams 15, 16.

A tread base 3 includes one or more wheel members 31, 32 attached to the rear portion thereof, for allowing the tread base 3 to be slid relative to the supporting surface or the ground 7, and includes a bracket 33 attached to the middle portion thereof, and includes one or more pivot shafts 37 provided on the front portion thereof, or laterally extended from the front portion thereof, and slidably engaged in the oblong holes 19 of the panels 18.

The tread base 3 may include an endless belt (not shown) engaged around one or more pulleys or rollers (not shown) and a plate or board (not shown), and a driving device (not shown) for driving the endless belt around the rollers and the board. The endless belt and the rollers and the board and the driving device are not related to the present invention and will not be described in further details.

One example of the endless belt and the rollers and the board and the driving device has been disclosed in the U.S. Pat. No. 5,772,560 to Watterson et al. which may thus be taken as a reference for the present invention.

The front portion of the tread base 3 may thus be moved or adjusted up and down relative to the seat 1 or the panels 18 when the pivot shafts 37 are slid along the oblong holes 19 of the panels 18 respectively (FIGS. 2, 3), for allowing the tread base 3 to be adjusted to different inclination or slope relative to the seat 1.

An actuating device 4 is further provided and coupled between the seat 1 and the tread base 3, to move the tread base 3 relative to the seat 1, and includes a conduit 41 pivotally coupled to the seat 1 with a pivot axle 8, a rod 42 slidably or adjustably received in the conduit 41, and having a free end pivotally coupled to the bracket 33 of the tread base 3, in order to be pivotally coupled between the seat 1 and the tread base 3.

For example, the actuating device 4 may be a pneumatic or hydraulic cylinder having the rod 42 movable or adjustable in and out of the conduit 41, in order to move the tread base 3 relative to the seat 1. Alternatively, the actuating device 4 may include a typical bolt 42 rotatably or threaded with the conduit 41 and may include a motor device 40 to rotate the bolt 42 relative to the conduit 41, in order to move the rod 42 in and out of the conduit 41.

A link or a lever 5 may further be provided, and may include one end coupled to the pivot axle 8 of the actuating device 4, and the other end coupled to the pivot shaft 37 of the tread base 3, for allowing the pivot axle 8 of the actuating device 4 and the pivot shaft 37 of the tread base 3 to be pivotally coupled together.

In operation, as shown in FIG. 2, the tread base 3 may be positioned or retained or supported in a horizontal position when the pivot shaft 37 of the tread base 3 is received in the lower or bottom end portion of the oblong hole 19 of the panel 18 of the seat 1. When the rod 42 is actuated or forced to move out of the conduit 41, the pivot axle 8 of the actuating device 4 may first be actuated or forced to move forwardly along the channel 9 of the seat 1, until the pivot axle 8 of the actuating device 4 is moved forwardly to engage or to be received in the front portion of the channel 9 of the seat 1.

Figure 3:
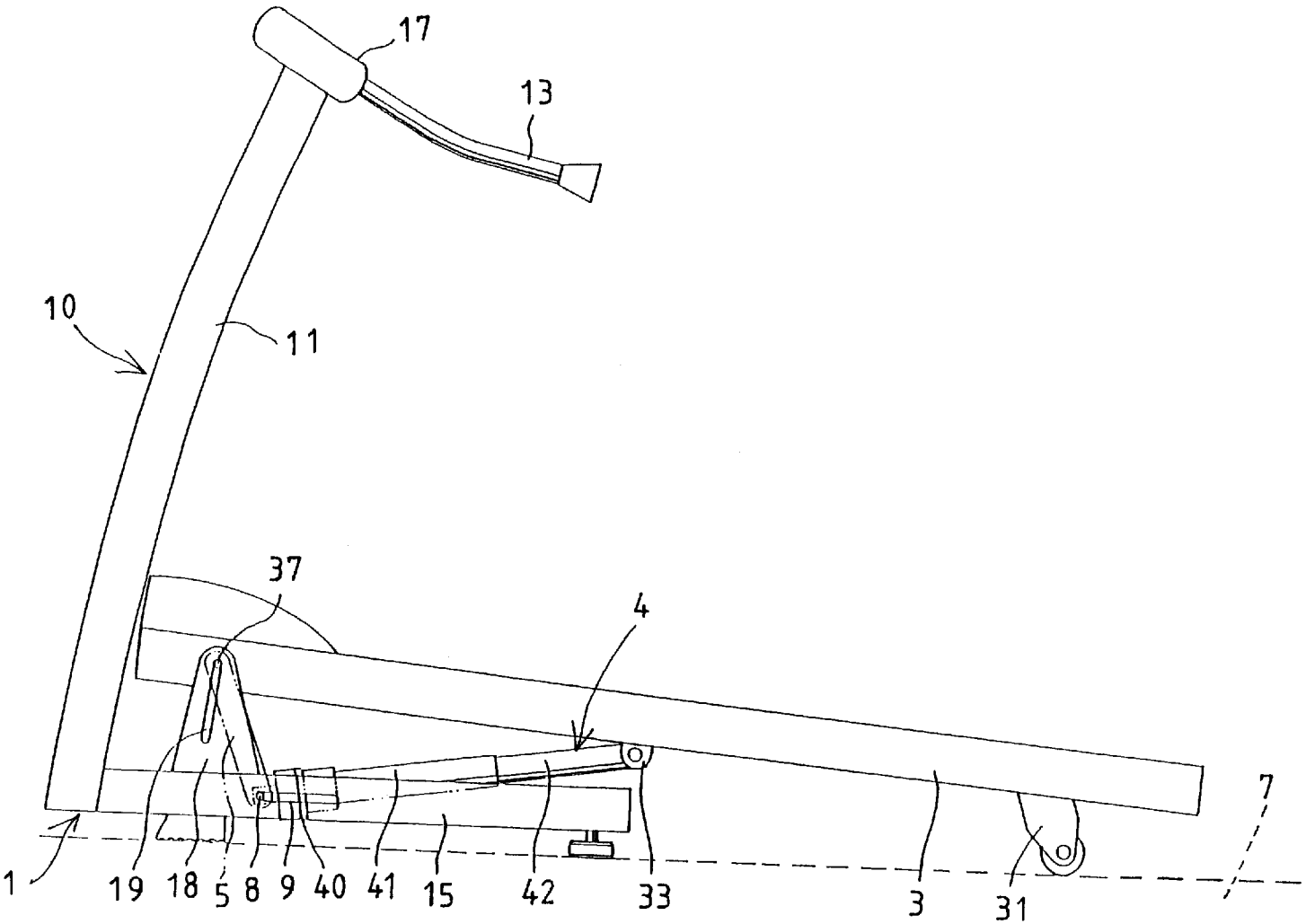
FIG. 3 is a side plan view similar to FIG. 2, illustrating the inclination or slope adjusting operation of the treadmill device.

As shown in FIG. 3, when the pivot axle 8 of the actuating device 4 is moved forwardly to engage with or to be received in the front portion of the channel 9 of the seat 1, the pivot shaft 37 of the tread base 3 may also be caused or forced to move upwardly toward the upper end portion of the oblong hole 19 of the panel 18 of the seat 1, until the pivot shaft 37 of the tread base 3 is engaged with the upper end of the oblong hole 19 of the panel 18, such that the front portion of the tread base 3 may be adjusted up and down relative to the seat 1 and such that the tread base 3 may be adjusted to different inclination or slope relative to the seat 1.

Figure 4:
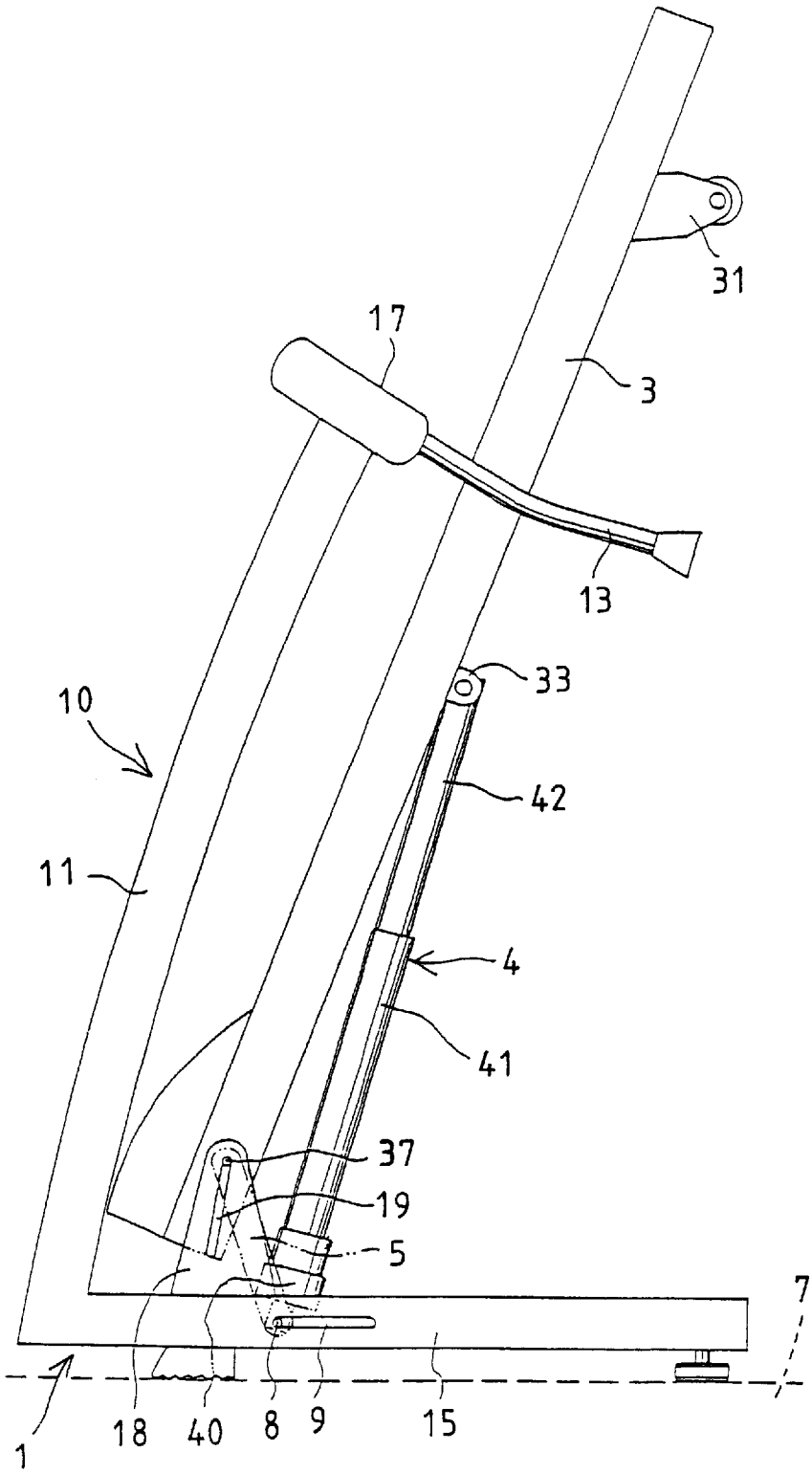
FIG. 4 is a side plan view similar to FIGS. 2, 3, illustrating the folding operation of the treadmill device.
Figure 5:
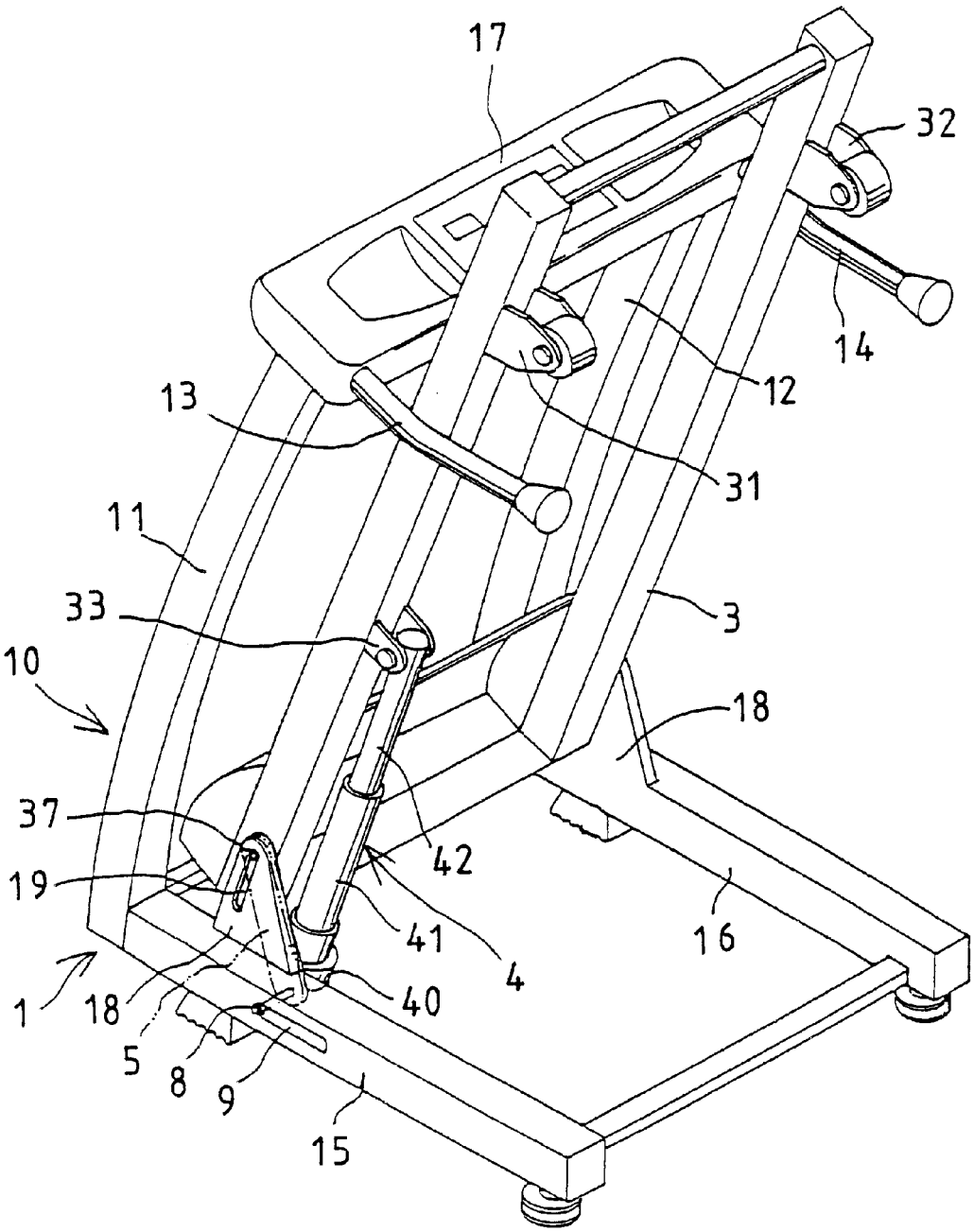
FIG. 5 is a perspective view of the treadmill device as shown in FIG. 4, which is located in the upwardly folding position.

As shown in FIGS. 4 and 5, when the rod 42 is further actuated or forced to move out of the conduit 41, the pivot axle 8 of the actuating device 4 may no longer be moved forwardly beyond the channel 9 of the seat 1, and the pivot shaft 37 of the tread base 3 may no longer be moved upwardly beyond the upper end of the oblong hole 19 of the panel 18. At this moment, the tread base 3 may be caused to rotate upwardly toward the frame 10, and to the folding or storing position as shown in FIGS. 4 and 5.

Accordingly, the treadmill device in accordance with the present invention includes a tread base having a greatly simplified configuration for allowing the treadmill device to be easily and quickly adjusted to different inclinations or slopes, and to be rotated or folded up to an upward folding or storing configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill device comprising:

a seat including a panel having an oblong hole formed therein, said oblong hole including an upper portion and a lower portion, and said seat including a channel laterally formed therein and having a front portion and a rear portion, a tread base including a rear portion, and including a front portion having a pivot shaft provided thereon and slidably received in said oblong hole, said pivot shaft of said tread base being movable up and down along said oblong hole, to adjust said tread base relative to said seat to different inclinations, an actuating device including a first end pivotally coupled to said tread base, and a second end having a pivot axle provided thereon and slidably received in said channel of said seat, and a lever coupled between said pivot shaft and said pivot axle, to pivotally couple said front portion of said tread base and said second end of said actuating device together, said actuating device being provided to move said pivot axle along said channel, and to move said pivot shaft along said oblong hole, and to rotate said tread base upwardly to a folding position when said pivot shaft is moved to said upper portion of said oblong hole, and when said pivot axle is moved to said front portion of said channel of said seat.

2. The treadmill device as claimed in claim 1, wherein said actuating device includes a conduit pivotally and slidably secured to said seat with said pivot axle, and a rod slidably received in said conduit and having a free end pivotally coupled to said tread base.

3. The treadmill device as claimed in claim 2, wherein said actuating device includes a motor device to move said rod in and out of said conduit.

4. The treadmill device as claimed in claim 1, wherein said seat includes a frame extended upward therefrom, and having at least one hand grip provided thereon to support users.

5. The treadmill device as claimed in claim 1, wherein said tread base includes at least one wheel device attached to said rear portion thereof to facilitate moving of said tread base relative to said seat.

* * * * *